US011649743B2

(12) United States Patent
Theußl et al.

(10) Patent No.: US 11,649,743 B2
(45) Date of Patent: May 16, 2023

(54) ELECTROMAGNETIC ACTUATOR

(71) Applicant: MSG Mechatronic Systems GmbH, Wies (AT)

(72) Inventors: Daniel Theußl, Deutschlandsberg (AT); Gerhard Schöner, Deutschlandsberg (AT); Ewald Lampl, Wies (AT)

(73) Assignee: MSG MECHATRONIC SYSTEMS GMBH, Wies (AT)

( * ) Notice: Subject to any disclaimer, the term of this patent is extended or adjusted under 35 U.S.C. 154(b) by 0 days.

(21) Appl. No.: 17/425,353

(22) PCT Filed: Jun. 27, 2019

(86) PCT No.: PCT/AT2019/060212
§ 371 (c)(1),
(2) Date: Jul. 23, 2021

(87) PCT Pub. No.: WO2020/154749
PCT Pub. Date: Aug. 6, 2020

(65) Prior Publication Data

US 2022/0082036 A1 Mar. 17, 2022

(30) Foreign Application Priority Data

Jan. 28, 2019 (AT) ..... GM 50013/2019

(51) Int. Cl.
*F01L 13/00* (2006.01)
*F01L 9/21* (2021.01)
*F01L 1/047* (2006.01)

(52) U.S. Cl.
CPC ... *F01L 13/0036* (2013.01); *F01L 2001/0473* (2013.01); *F01L 2009/2107* (2021.01);
(Continued)

(58) Field of Classification Search
CPC . F01L 9/21; F01L 13/0036; F01L 2009/2107; F01L 2009/2134;
(Continued)

(56) References Cited

U.S. PATENT DOCUMENTS 3,504,315 A * 3/1970 Stanwell ..... H01F 7/1615 335/254
5,272,458 A 12/1993 Hoffman et al.
(Continued)

FOREIGN PATENT DOCUMENTS

CN 102639824 A 8/2012
CN 104520947 A 4/2015
(Continued)

OTHER PUBLICATIONS

International Search Report issued in International Patent Application No. PCT/AT2019/060212, dated Oct. 2, 2019, along with an English translation thereof.
(Continued)

*Primary Examiner* — Jorge L Leon, Jr.
(74) *Attorney, Agent, or Firm* — Greenblum & Bernstein, P.L.C.

(57) ABSTRACT

An electromagnetic actuator having at least one electromagnetic actuator unit, the actuator unit comprising a coil and a plunger, which plunger is axially movable relative to the coil via energization of the coil, and the actuator unit being arranged in a housing. In order to achieve a particularly simple design, the plunger is arranged approximately coaxially with the coil according to the invention.

23 Claims, 4 Drawing Sheets

(52) U.S. Cl.
CPC ..... *F01L 2009/2134* (2021.01); *F01L 2013/0052* (2013.01); *F01L 2013/101* (2013.01); *F01L 2820/031* (2013.01)

(58) Field of Classification Search
CPC ..... F01L 2013/0052; F01L 2820/031; F01L 2001/0473; F01L 2013/101
USPC ..... 123/90.18
See application file for complete search history.

(56) References Cited

U.S. PATENT DOCUMENTS

| | | | | |
|---|---|---|---|---|
| 2004/0201441 | A1 | 10/2004 | Elendt et al. | |
| 2012/0235777 | A1* | 9/2012 | Elendt | F01L 13/0036 335/229 |
| 2015/0213936 | A1 | 6/2015 | Bürßner et al. | |
| 2016/0125991 | A1* | 5/2016 | Wardle | F01L 13/0036 335/232 |
| 2020/0308994 | A1* | 10/2020 | Suzuki | H01F 7/1607 |

FOREIGN PATENT DOCUMENTS

| | | | |
|---|---|---|---|
| CN | 107676143 | A | 2/2018 |
| CN | 111094707 | A | 5/2020 |
| DE | 10 2006 035 225 | | 2/2007 |
| DE | 10 2006 034 922 | | 1/2008 |
| DE | 10 2007 028 600 | | 12/2008 |
| DE | 10 2007 052 252 | | 5/2009 |
| DE | 10 2008 029 324 | | 12/2009 |
| DE | 10 2010 045 601 | | 3/2012 |
| DE | 10 2015 103 169 | | 9/2016 |
| DE | 10 2017 115 975 | | 2/2018 |
| DE | 10 2016 116 776 | | 3/2018 |
| DE | 10 2016 116 777 | | 3/2018 |
| WO | 2009/056223 | A1 | 5/2009 |
| WO | 20 11042273 | | 4/2011 |
| WO | 2014/023451 | A1 | 2/2014 |
| WO | 2019/007675 | A1 | 1/2019 |
| WO | 2019/057401 | A1 | 3/2019 |

OTHER PUBLICATIONS

Written Opinion of the International Searching Authority issued in International Patent Application No. PCT/AT2019/060212, dated Oct. 2, 2019.

Search Report issued in Austrian Application No. GM 50013/2019, dated Feb. 6 2020.

Office action from the National Intellectual Property Administration, PRC for counterpart China Application No. 201980090430.8, dated Dec. 6, 2022, along with an English language translation of the Office action.

* cited by examiner

ELECTROMAGNETIC ACTUATOR

The invention relates to an electromagnetic actuator with at least one electromagnetic actuator unit, the actuator unit having a coil and a plunger, which plunger can be moved axially relative to the coil by energizing the coil, the actuator unit being arranged in a housing.

Various actuator units of the type mentioned at the beginning have become known from the prior art. Such actuator units are used in particular for a camshaft actuator. To enable camshaft adjustment in different directions, for example to be able to operate an engine with two or more different cam geometries, actuators with at least one actuator unit, preferably multiple independently controllable actuator units, are required, the actuator units being separated only a few millimeters apart. For this purpose, a corresponding device has become known from DE 10 2007 028 600 B4, for example, with which multiple plungers can be actuated in a limited installation space. The disadvantage of this device is that it can only be manufactured with great effort and therefore very expensively.

This is where the invention comes into play. The object of the invention is to provide an actuator of the type mentioned at the outset which can be produced in a simpler and more cost-effective manner and yet meets requirements with regard to a required service life.

According to the invention, this object is achieved by an actuator of the type mentioned at the outset, in which the plunger is arranged approximately coaxially with the coil.

In the context of the invention, it was recognized that the production of the device described in document DE 10 2007 028 600 B4 is so complex because the plungers are arranged eccentrically to the coils, so that when the plungers are actuated, an eccentric force is applied to the plungers which causes a torque about a transverse axis of the typically approximately parallel plunger, which is perpendicular to a longitudinal axis of the plunger. This torque must go through a particularly
complicated guidance of the plunger must be considered in order to avoid tilting of the plunger.

After the actuator unit is arranged approximately centrally to the coil in the actuator according to the invention, so that a longitudinal or central axis of the coil coincides approximately with a longitudinal axis of the plunger assigned to the coil and the plunger is approximately coaxial with the coil, a corresponding torque is generated here around a transverse axis, that is to say around an axis perpendicular to the longitudinal axis, avoided in a simple manner, so that there is no need for a complex slide guide. With the embodiment according to the invention, a lower load is thus achieved, which is why a long service life can be guaranteed despite the simpler mounting. Although the actuator according to the invention can in principle be designed with a single or any number of actuator units, it is particularly advantageous if exactly two actuator units are arranged in an actuator in order to achieve a compact design. It goes without saying that in an embodiment with multiple actuator units, as a rule, each actuator unit is designed according to the invention.

To use the actuator for cam adjustment in an internal combustion engine, it is particularly advantageous if at least two actuator units are provided, the plungers of all actuator units being arranged approximately coaxially with the coils, all actuator units preferably being arranged in a common housing. This allows a sleeve to be axially displaced in a simple manner on a camshaft. Because of this embodiment, a particularly small distance between the plungers is possible with a simple and inexpensive embodiment at the same time.

It is favorable if the plunger, preferably each in an actuator with multiple actuator units, can be moved from an end position near the core to an end position away from the core, the plunger resting against stops in each of the end positions. As a result, the motion of plungers is predefined in a simple manner with a high degree of accuracy. The stops are typically formed by metallic components, in particular made of a magnetizable material.

The actuator is normally designed as a bistable actuator so that the plunger or plungers remain stable in the end positions when the coils are de-energized.

It is preferably provided that, in the case of an actuator with multiple actuator units, preferably on each, a permanent magnet is arranged to the plunger. As a result, the plungers automatically adhere in the end positions and thus a bistable device is provided in a simple manner.

A particularly simple embodiment results when the coil, preferably each coil in an actuator with multiple actuator units, is arranged around a core, the permanent magnet being magnetically separated from the core in the axial direction only through an air gap. No further device, in particular no metallic or magnetizable device such as an armature element, is therefore provided between the permanent magnet and the core. The core is typically made of a very good magnetically flux-conducting material, for example a leaded soft automatic steel.

A preferable embodiment includes an anchor element, in particular an anchor plate, to be arranged on the plunger; in the case of an actuator with multiple actuator units, preferably on each plunger. The anchor element, which is typically made of a magnetizable metal, is typically rigidly connected to the plunger, for example through a laser weld seam, and can be moved by energizing the coil through the resulting magnetic field, so that a force is applied to the plunger through the anchor plate by means of energizing the Coil can be applied to move the plunger electromagnetically. As a rule, the plunger and the coil are arranged in a metallic jacket, through which a magnetic circuit can be closed, so that a magnetic flux starting from the coil through the core, the armature plate and the jacket with low magnetic resistance is possible.

Usually, in the case of an actuator with multiple actuator units, preferably each plunger is mounted in the actuator so that it can rotate freely about the longitudinal axis. This minimizes wear on the plungers, especially since they can possibly roll-on sleeves with which the plungers interact during camshaft adjustment.

It has been proven that in the case of an actuator with multiple actuator units, a permanent magnet and an armature element are arranged on each plunger, the armature element protruding beyond the permanent magnet in a plane perpendicular to a longitudinal axis of the actuator unit. A magnetic circuit can then close with a particularly low magnetic resistance from the coil through the armature element and a jacket, so that efficient actuation of the plungers through the coils is possible.

The advantage is, in the case of an actuator with multiple actuator units, preferably each, that the plunger is connected indirectly or directly to the coil assigned to the plunger through a spring. This way, along with the permanent magnet, a force balance of magnetic force and spring force can be achieved, with a resulting force or total force being able to be influenced with little effort by additional energization of the coil, or a direction of the total force being reversible by energizing the coil around the actuator unit to operate. The coil can be designed, for example, to produce a corresponding magnetic field when a predefined voltage is applied, in particular a voltage from an actuation voltage of, for example, 12 volts available in a motor vehicle. For example, the spring can be supported on the core or on a yoke disk arranged behind the core. Furthermore, a spring can be used to reduce the speed of the plunger when it moves counter to the stroke direction before the plunger strikes a stop on the core side. This reduces wear on the stop. This is particularly advantageous if the stop is made from a core made of a soft, easily magnetizable material and a contact area between the plunger and the core is small in order to prevent the plunger from sticking to the core, in particular due to an oil film on the contact surface. Thus, by using the spring between the plunger and the core, a stop device made of a hard material can be dispensed with, which ensures a particularly simple embodiment.

Furthermore, when a spring is used between the plunger and the coil, a particularly favorable use of a force acting on the plunger can be achieved over a stroke, so that an armature element, in particular a magnetically conductive anchor plate arranged on the plunger is not required to move the plunger between the end positions with a low energy supply.

It is preferable if the spring, the armature element, the permanent magnet and the coil are designed and coordinated with one another in such a way that, when the coil is de-energized, a combined force of spring force and magnetic force results, which pushes the plunger from a predefined minimum distance from an end position close to the core, in particular when the distance between the plunger and the end position near the core is less than 1 mm, it pulls into the end position near the core. This ensures a stable position of the plunger in the end position near the core in a simple manner when the coil is de-energized.

It is preferable that the spring, the armature element, the permanent magnet, and the coil are designed and coordinated with one another in such a way that, when the coil is energized, a total force of spring force and magnetic force results, which moves the plunger located in an end position close to the core into an end position away from the core. When the coil is energized, a current is applied to the armature element or the plunger
so the spring, the permanent magnet, and the magnetic force on the plunger result from the magnetic flux when the coil is energized, which pushes the plunger away from the end position near the core in order to operate the actuator or the actuator. As a rule, the spring force acts on the plunger located in the end position near the core in a stroke direction which points from the end position near the core to the end position away from the core, while the force of the permanent magnet typically pulls the plunger near the end position near the core and thus against the end position direction of stroke is aligned. The magnetic force on the armature element resulting from the magnetic flow through the coil when the coil is energized is typically also aligned in the stroke direction.

The actuator is typically designed in such a way that the plunger is moved away from the end position near the core by means of the spring and the force on the armature element caused by the magnetic flow until the plunger is pulled into an end position away from the core by the permanent magnet. As a rule, the plunger can be pulled by the permanent magnet from a distance of less than 1 mm from the end position away from the core into the end position away from the core. It is preferable that both in the end position close to the core and in the end position distant from the core, devices which can be magnetized or interact with the permanent magnet are arranged so that the plunger is pulled into the respective end position by the permanent magnet located in the vicinity of the respective end position.

It is advantageously provided that the spring, the armature element, the permanent magnet, and the coil are designed and coordinated with one another in such a way that a plunger located in an end position away from the core remains in the end position away from the core regardless of a current supply to the coil and only through an additional force applied to the plunger in a form-fitting manner can be moved from the end position away from the core.

The plunger preferably adheres by means of the permanent magnet in the end position away from the core, typically on a metallic component, in particular a plate. Moving the plunger back from the end position away from the core is therefore only possible by actively moving the plunger, which can be done, for example, by having a sleeve on a camshaft with a cam track. As a result, a bistable actuator is achieved in a simple manner, which is stable in a current-less state of the coil both in the end position near the core and in the end position away from the core. The sleeves with which the plungers in camshaft actuators interact, typically have a groove following a cam track with a depth that can be varied over a circumference, so that the plunger can be moved back from the end position away from the core by rotating the sleeve or rotating the camshaft.

It has been proven that a stop device, in particular an approximately hemispherical stop device, preferably a ball or pin, is provided on the at least one actuator unit, preferably on each actuator unit in the case of an actuator with multiple actuator units, so that the plunger assigned to the respective actuator unit is in an end position close to the core rests on the stop device. By means of a stop near the core, an end position of the plunger near the core can be established in a simple manner with high accuracy.

The plunger is typically designed at an end on the core side in such a way that a point-like contact surface is produced when it comes into contact with the stop device. For example, the plunger can have a flat point at an end on the core side or a contact surface can run perpendicular to a longitudinal axis of the plunger so that the contact surface is designed, for example, as a circular disk if the plunger is cylindrical. An end position of the plunger can be defined particularly easily and at the same time with high accuracy by means of a point-shaped contact surface, which results when there is contact with a ball or an approximately hemispherical pin at the end. Corresponding balls and pins are mass-produced and therefore available in high quality with low cost.

The stop device can in principle be connected to the core in any desired manner, in particular rigidly, for example pressed into the core or fixed in a component rigidly connected to the core, in particular a yoke disk. In order to minimize wear, the stop device can also be connected directly or indirectly to the coil of the respective actuator unit through a spring. An indirect connection can be made, for example, when the stop device is connected through the spring to a yoke disk arranged at an end of the core opposite a plunger-side end of the core and which is rigidly connected to the core and thus also to the coil. Furthermore, the spring can be connected to a core assigned to the respective actuator unit or to a component rigidly connected to the core, such as the yoke disk. In this embodiment, when moving from the end position away from the core, the plunger initially contacts the stop device connected to the core through the spring, after which the stop device is moved along with the plunger until the stop device is connected to the core or a stop device connected to the core, in particular hits a component rigidly connected to the core, preferably on a stop plate arranged in the core or on a yoke disk connected to the core.

It is favorable if the stop device rests against a yoke disk connected to a core of the actuator unit, in particular fixed on the yoke disk. As a result, mechanical stress on the core can be minimized in a simple manner. Usually, the yoke disk on which the stop device rests is arranged on a rear side of the core, which is a front side of the core, on which the plunger is positioned and which can also be referred to as opposite to the end of the core on the plunger side.

It is preferably provided that the stop device is arranged in a pass-through hole arranged in the core and preferably projects beyond the core on both sides along a longitudinal axis. If the stop device is supported on a component such as the yoke disk, which is rigidly connected to the core and the coil and which is arranged on a side of the core opposite the plunger in the direction of the longitudinal axis, a mechanical load on the core can occur when the plunger hits the stop device can be avoided entirely, so that a particularly long service life is achieved. In order to enable contact of the plunger with the stop device, the core then typically has a pass-through hole into which the stop device and/or the plunger protrude when the plunger is in an end position close to the core. To minimize the moving masses, it is advantageous if the stop device, which is typically rigidly connected to the coil, is arranged entirely in the pass-through hole in the core and protrudes through the core, but without the core being connected to the stop device in such a way that forces are transmitted in the direction of the longitudinal axis between the stop device and the core, so that the stop device protrudes beyond the core on both sides in the direction of the longitudinal axis. It has surprisingly been shown that when a pass-through hole is made in the core, the service life of the device can be increased because the stop device is then no longer supported on the core, which is typically made of a soft material, but is supported on a component arranged behind the core can, whereby the core is not stressed.

In order to be able to ensure a highly precise end position of the plunger even after a long period of use, it is preferably provided that the stop device has a higher hardness than a core assigned to the actuator unit. The core typically has favorable magnetic properties in order to obtain the lowest possible resistance of a magnetic circuit by means of which the plunger can be actuated by energizing the coil. The stop device, on the other hand, can be made of a material such as 100Cr6, for example.

A predefined plunger movement can be achieved in a simple manner if a plunger guide is provided in which the plunger is mounted for sliding, preferably assigned to each plunger, in the case of an actuator with multiple actuator units. A total force on the plunger resulting from the spring force and magnetic force thus causes motion along the plunger guide depending on the direction of the total force. The plunger guide is preferably made from a metal. In the case of an actuator with multiple actuator units, it can be provided that multiple plunger guides are arranged in a common component and are formed, for example, by cylindrical bores in a guide body.

If at least two actuator units are provided, however, it is particularly advantageous if each plunger is mounted for sliding in a separate plunger guide which is movable relative to one another. This enables a particularly simple connection to a device on which the actuator acts, in particular to a motor, especially since positional tolerances at a mechanical interface with the device on receiving bores on the motor in which the plungers engage, compensated for by the movability of the plunger guides relative to one another. The plunger guides are preferably also movable relative to the coils or the housing in which the coils are arranged. It goes without saying that a minimal mobility of a few degrees or a few millimeters can be sufficient to compensate for positional tolerances.

In terms of design, this can be achieved, for example, if a plunger guide is provided for each plunger in the case of multiple plungers and the plunger guides are arranged in separate guide bodies, the guide bodies being movable relative to one another. This can be implemented, for example, when separate guide bodies move connected to the housing or a component of the actuator that is rigidly connected to the coil. A correspondingly movable connection of the plunger guides to the housing can be achieved in a simple manner, for example, by a guide body connected to the housing by means of a clearance fit or a component rigidly connected to the housing.

The plunger guide can be formed in the guide body, for example, by means a pass-through hole. This makes attaching the actuator on an engine or a cylinder head cover of an engine possible, especially since deviations on the engine and/or on the actuator can be easily compensated by the low mobility of the guide body relative to the housing due to the clearance fit. The guide bodies can then be designed, for example, as turned parts, which can be produced simply and inexpensively. Such an embodiment also makes the actuator easily scalable. Adjusting devices with any number of actuator units can then also be produced in a simple manner with appropriate guide bodies, with positional deviations of receiving bores on a motor being able to be compensated for at the same time.

The actuator is typically attached to a cylinder head cover of an internal combustion engine and the plungers engage in correspondingly provided recesses or bores in the cylinder head cover or in the engine, through which recesses or bores the plungers interact with the sleeves arranged on the camshaft. The plunger guides arranged in separate guide bodies thus provide a simple possibility of compensating for tolerances between the recesses or bores.

The plungers are typically designed with an approximately cylindrical external contour. Corresponding to this external contour, the guides are also preferably approximately cylindrical, and the guides have a diameter which corresponds to a maximum diameter of the plungers.

In order to achieve particularly low wear, it is advantageous if the plungers have a central taper, which is positioned in the plunger guide for every possible plunger position between an end position of the plunger close to the core and an end position of the plunger away from the core. The actuator is typically arranged on a camshaft in an engine, and thus in an oil mist. Oil can then collect around the taper, which ensures good lubrication of a contact surface between the plungers and the guide.

A particularly cost-effective embodiment can be achieved if a core arranged in the coil has an approximately cylindrical external contour, with a maximum external diameter of the core smaller than or equal to an inner diameter of the coil. The core thus preferably has no shoulder or the like on the outside, so that it can be easily manufactured, for example from a cylindrical starting material.

To achieve a high degree of efficiency, it is advantageous if a preferably plate-shaped component made of a magnetically conductive material, in particular a yoke washer, is arranged and connected to the core at an end of the core on the plunger side and/or on an end of the core opposite the end on the plunger side, which component protrudes beyond the core in a direction radial to the longitudinal axis. As a result, despite a core that can be manufactured inexpensively with a cylindrical external contour which does not protrude beyond an inner diameter of the coil, a low magnetic resistance can be achieved between the core and the jacket. The magnetic circuit can then be formed in a cost-effective manner from the core, the yoke disks arranged at both ends of the core and the jacket and the magnetically conductive parts of the plunger. Yoke disks are typically circular ring-shaped and made of an easily magnetizable plate material, typically different from the material from which the core is formed. With such an embodiment in which the core and the two yoke disks are formed by separate components, manufacturing costs can be reduced compared with an embodiment in which the core and the yoke disks are formed by a single component.

In principle, the actuator according to the invention can be used for any purpose. The advantages of the actuator according to the invention can be used particularly well if this is used in a camshaft actuator for adjusting an axially movable sleeve on a camshaft in an internal combustion engine with an electromagnetic actuator.

Further features, advantages and effects of the invention emerge from the exemplary embodiment are shown below. In the drawings to which reference is made:

Figure 1:
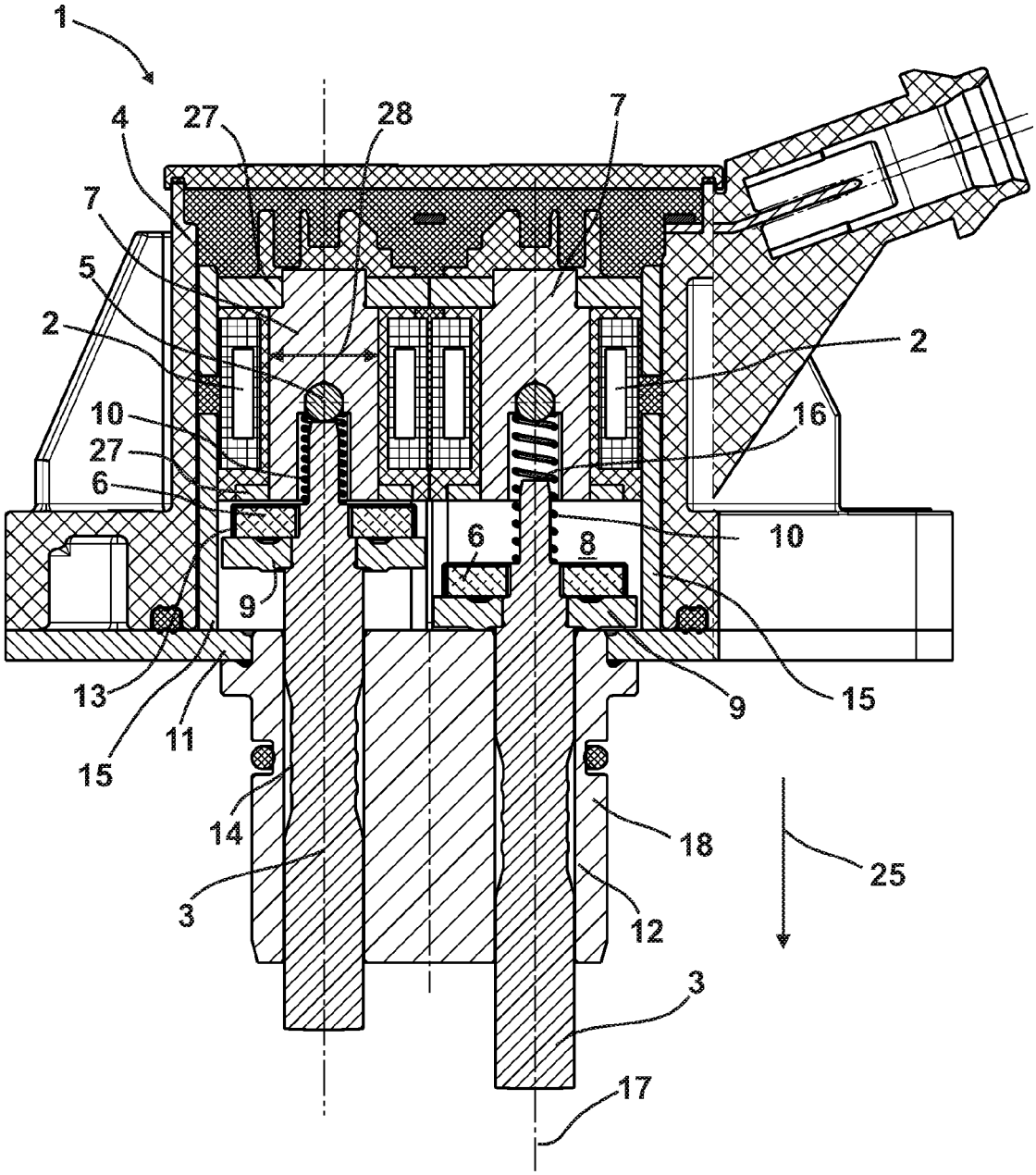
FIG. 1 shows an actuator according to the invention in a sectional illustration.

FIG. 1 shows a sectional view of an actuator 1 according to the invention. As it can be seen, two actuator units are provided in a common housing 4 in the illustrated embodiment, each actuator unit having a coil 2, a core 7 around which coil 2 is arranged, a plunger 3 extending along a longitudinal axis 17, a spring 10 which connects the plunger 3 to the core 7, has a permanent magnet 6 and an armature element formed by an armature plate 9.

A magnetic circuit, through which plunger 3 can be actuated by means of coil 2, is closed through a jacket 15 in which coil 2 is arranged and through which the coil 2 is magnetically connected to the armature element on plunger 3.

As shown, in order to ensure a small distance between the plungers 3, it is advantageous if jacket 15 is arranged to enclose both cores 7, but no jacket 15 is positioned between core 7.

As it can also be seen, plungers 3 are each arranged coaxially to the longitudinal axes 17 of coils 2 or centrally to coils 2. The longitudinal axis 17 of plunger 3 thus coincides with the longitudinal axes 17 of plunger 3. As a result, when the same is actuated by means of a magnetic force caused by coils 2, no torque acts on plunger 3 about an axis transverse to the longitudinal axis 17, which is why the plunger guide 12 can be designed in a particularly simple manner.

In order to be able to manufacture actuator 1 particularly cost-effectively, core 7 arranged in coil 2 has an essentially cylindrical external contour, with a maximum external diameter 28 of core 7 corresponding approximately to a minimum inner diameter of coil 2. It goes without saying that coil 2 here is understood to mean not only the windings themselves, but also a component carrying the windings which is located between core 7 and the windings themselves.

In order to achieve a low magnetic resistance between core 7 and jacket 15, there are both on an end of core 7 on the plunger side and on an end of core 7 opposite the end on the plunger side Yoke disks 27, which protrude radially beyond core 7 relative to the longitudinal axis 17, are arranged to establish a magnetic connection between core 7 and jacket 15. Yoke disks 27 are made from an easily magnetizable plate material and have an approximately circular cross-section in a section perpendicular to longitudinal axis 17.

Anchor plate 9 protrudes on each plunger 3 in a plane perpendicular to longitudinal axis 17 or perpendicular to the image plane beyond the permanent magnets 6 of the respective plungers 3, so that a magnetic circuit can close over anchor plate 9. Permanent magnets 6 are only separated from core 7 by an air gap 8. An approximately hollow cylindrical protective sleeve 13 is arranged around each permanent magnet 6. A magnetic flux produced by means of coil 2 and the magnetic circuit thus runs essentially through core 7, plunger 3, armature plate 9 and jacket 15.

As a result, a force can be applied to the armature element or the respective plunger 3 by energizing coil 2, the force of which moves plunger 3 away from the end position 23 near the core.

Of the two actuator units shown in FIG. 1, the plunger 3 of the actuator unit shown on the left is in an end position 23 near the core and plunger 3 of the actuator unit shown on the right on FIG. 1 is in an end position 24 away from the core. In the end position 23 near the core, plunger 3 rests against a stop device designed as a ball 5, which in turn is positioned in core 7 so that the core near the end position 23 of plunger 3 is defined in a simple and at the same time highly accurate manner. Plungers 3 make contact with the ball 5 at an approximately circular disk-shaped, essentially flat, contact surface 16, so that a point-like contact results. In order to be able to ensure the exact position of the end position 23 near the core over a long period of time or a desired service life of a motor in which actuator 1 is used, the stop device is made of a material with a high hardness or a hardness higher than core 7.

Plungers 3 are guided in plunger guides 12, which are formed by cylindrical bores in a guide body 18. Plungers 3 also have a cylindrical external contour in some areas, which interacts with the plunger guides 12, so that plungers 3 can only be moved translationally in the direction of longitudinal axis 17 and rotationally about longitudinal axis 17, but beyond that there is no movement of plungers 3 relative to the housing 4 or to guide body 18.

As can also be seen, plungers 3 in plunger guides 12 have tapers 14 in which oil can be collected in order to lubricate a movement of plungers 3 in the guides and thus to minimize wear.

Plungers 3 are connected to core 7 through spring 10 and permanent magnet 6 in such a way that spring 10 exerts a force on plunger 3 in stroke direction 25, i.e. from end position 23 near the core in the direction of end position 24 away from the core parallel to longitudinal axes 17, is exercised when plungers 3 are in the end position 23 near the core. In the end position 23 close to the core, permanent magnets 6 apply a force counteracting the spring force 20 to plunger 3, the magnitude of which is greater than spring force 20, so that plunger 3 is in a current-less state of coil 2 due to a total force of magnetic force and spring force 20 and held in end position 23 near the core. The total force thus acts against stroke direction 25 when coil 2 is de-energized.

In order to operate an actuator unit and move the corresponding plunger 3 out of the end position 23 near the core, an electrical voltage is applied to the coil 2 of this actuator unit, creating a magnetic flux in the magnetic flux formed by the core 7, casing 15, plunger 3 and armature plate 9 Circle causes a force on the plunger 3 in the stroke direction 25, so that the total force acting on the plunger 3 points in the stroke direction 25 and the plunger 3 is moved from the end position 23 near the core.

When actuated accordingly, plunger 3 is moved into end position 24 away from the core, in which plunger 3 rests against a stop formed by metallic plate 11.

The longitudinal axes 17 of both plungers 3 are approximately parallel, as shown, and when the actuator 1 is used, they are typically less than 25 mm, in particular 6 mm to 15 mm, spaced from one another. With the design of actuator 1 according to the invention, a force sufficient for camshaft adjustment can be provided despite the small distance.

Figure 2:
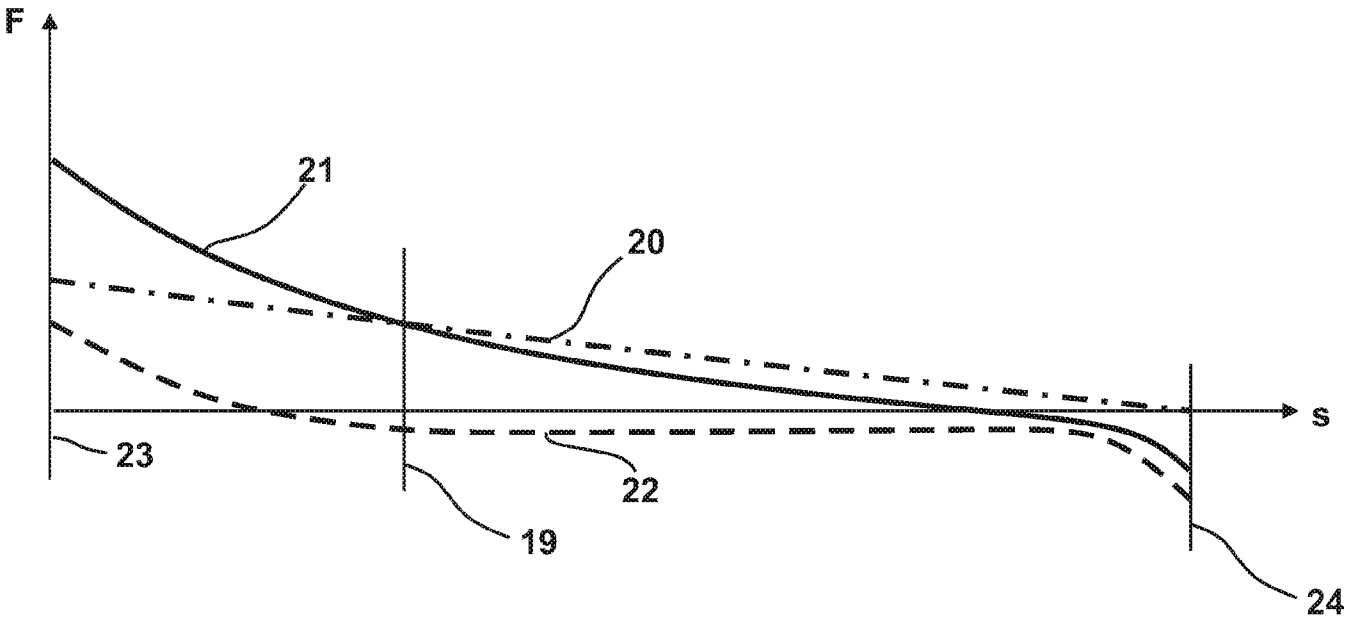
FIG. 2 shows a diagram from which forces acting on a plunger can be inferred over a stroke.

FIG. 2 schematically shows the forces acting on a plunger 3 of an actuator unit as a function of a stroke of plunger 3 starting from the end position 23 near the core in stroke direction 25 to an end position 24 of plunger 3 away from the core.

Both a magnetic force and a force of permanent magnet 6 and a magnetic force caused by energizing coil 2 on plunger 3, as well as a spring force 20 resulting from spring 10, the magnetic force being shown in solid line for a situation in which coil 2 is not energized and in a broken line for a situation in which coil 2 is energized. The solid line thus represents a current-less magnetic force 21, which is caused by permanent magnet 6 alone, and the broken line represents the energized magnetic force 22, which is a total force of permanent magnet 6 and the magnetic force formed by the energization of coil 2 on Plunger 3. In the case of spring force 20, a force in the stroke direction 25 is shown as a positive force, while in the case of the de-energized magnetic force 21 and energized magnetic force 22 positively represented forces aligned against stroke direction 25. On the ordinate of the diagram, values in the stroke direction 25 with respect to spring force 20 and values against the stroke direction 25 with respect to the magnetic forces are thus shown.

As it can be seen, a current-less magnetic force 21 holding plunger 3 in the end position 23 near the core, that is to say with a stroke of 0 mm, is greater than spring force 20 during this stroke. When coil 2 is de-energized, plunger 3 is therefore held in end position 23 near the core by permanent magnet 6. As shown, spring force 20 decreases over the stroke and approaches zero in end position 24 of plunger 3 away from the core. This ensures that when plunger 3 moves, spring 10 is never without a defined position between core 7 and plunger 3 or is loose, which could lead to the development of noise and wear.

If coil 2 is energized, plunger 3 is reduced in the area close to the magnetic force holding the end position 23 is less than the amount of spring force 20, so that the current-less magnetic force 21 acts, whereby the plunger 3 moves away from end position 23 near the core when coil 2 is energized by spring force 20.

As it can also be seen, plunger 3 is pulled near an end position 24 away from the core into end position 24 away from the core. This is done by a magnetic force brought about by permanent magnet 6, by means of which plunger 3 is pulled to a plate 11 which forms a stop in the end position 24 away from the core.

Plunger 3 is thus positionally stable both in end position 23 near the core and in end position 24 away from the core when the coil 2 is de-energized. In order to move plunger 3 away from end position 24 away from the core back into end position 23 near the core, plunger 3 is moved, for example, by means of a sleeve into which plunger 3 engages in a camshaft actuator, at least up to a minimum return position 19 counter to stroke direction 25. From this minimum return position 19, the magnetic force of permanent magnet 6 pulling plunger 3 into end position 23 near the core when coil 2 is de-energized, i.e. the de-energized magnetic force 21 against the stroke direction 25 is greater than spring force 20 in stroke direction 25, so that a resulting force acts against stroke direction 25 on plunger 3 and plunger 3 is pulled from the minimum return position 19 into end position 23 near the core when coil 2 is de-energized.

Figure 3:
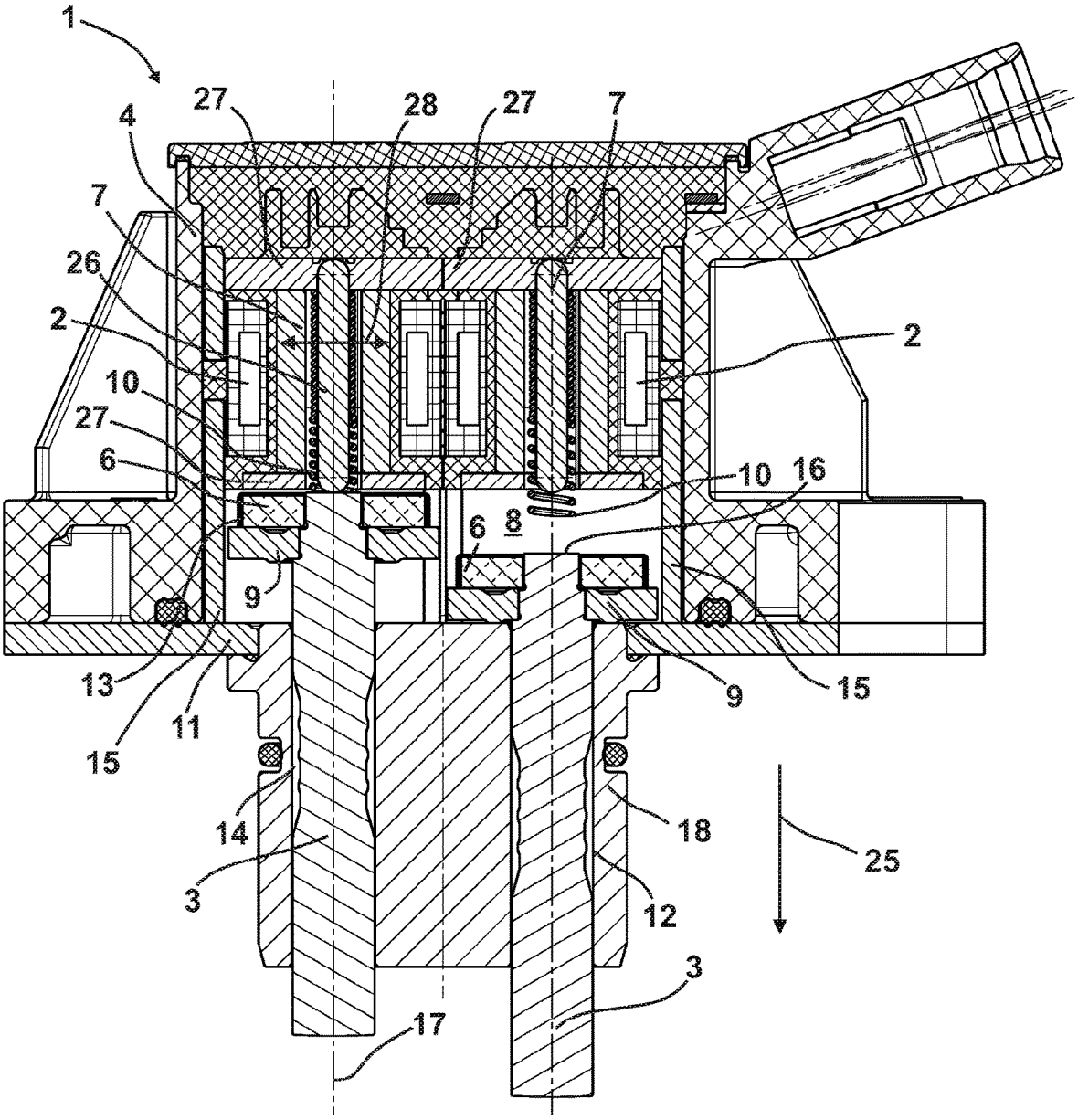
FIGS. 3 and 4 show further embodiments of an actuator according to the invention in sectional illustration.

FIG. 3 shows a further actuator 1 according to the invention, which is basically constructed similarly to the actuator 1 shown in FIG. 1, but in contrast to the actuator 1 shown in FIG. 1 has a pin 26 as a stop device. As shown, the stop device embodied as pin 26 is supported here on one behind the core 7 or on a yoke disk 27 arranged opposite a rear side of the core 7 opposite an end of core 7 on the side of the plunger, so that core 7 is not mechanically stressed when plunger 3 strikes. In order to be able to transmit a force from plunger 3 to yoke disk 27 when plunger 3 strikes, without mechanically stressing the core 7, a pass-through hole is provided in the core 7 in this embodiment. In the embodiment shown, pin 26 is positioned in the pass-through hole and protrudes from core 7 on both sides, without contacting core 7 or a yoke disk 27 arranged at an end of core 7 on the plunger side in a manner suitable for the transmission of forces in the direction of longitudinal axis 17. Furthermore, a spring 10 is also provided in this embodiment, which is also supported here on yoke disk 27 and penetrates the pass-through hole in the core. Alternatively, spring 10 could of course also be supported on core 7, for example on a shoulder in the pass-through hole in core 7. This design achieves an increased service life because core 7 is not mechanically stressed with every stop of plunger 3. The pass-through hole can lead to a magnetic weakening 7 of core 7 or to an increased magnetic resistance of core 7, which are accepted in order to minimize the mechanical load.

Figure 4:
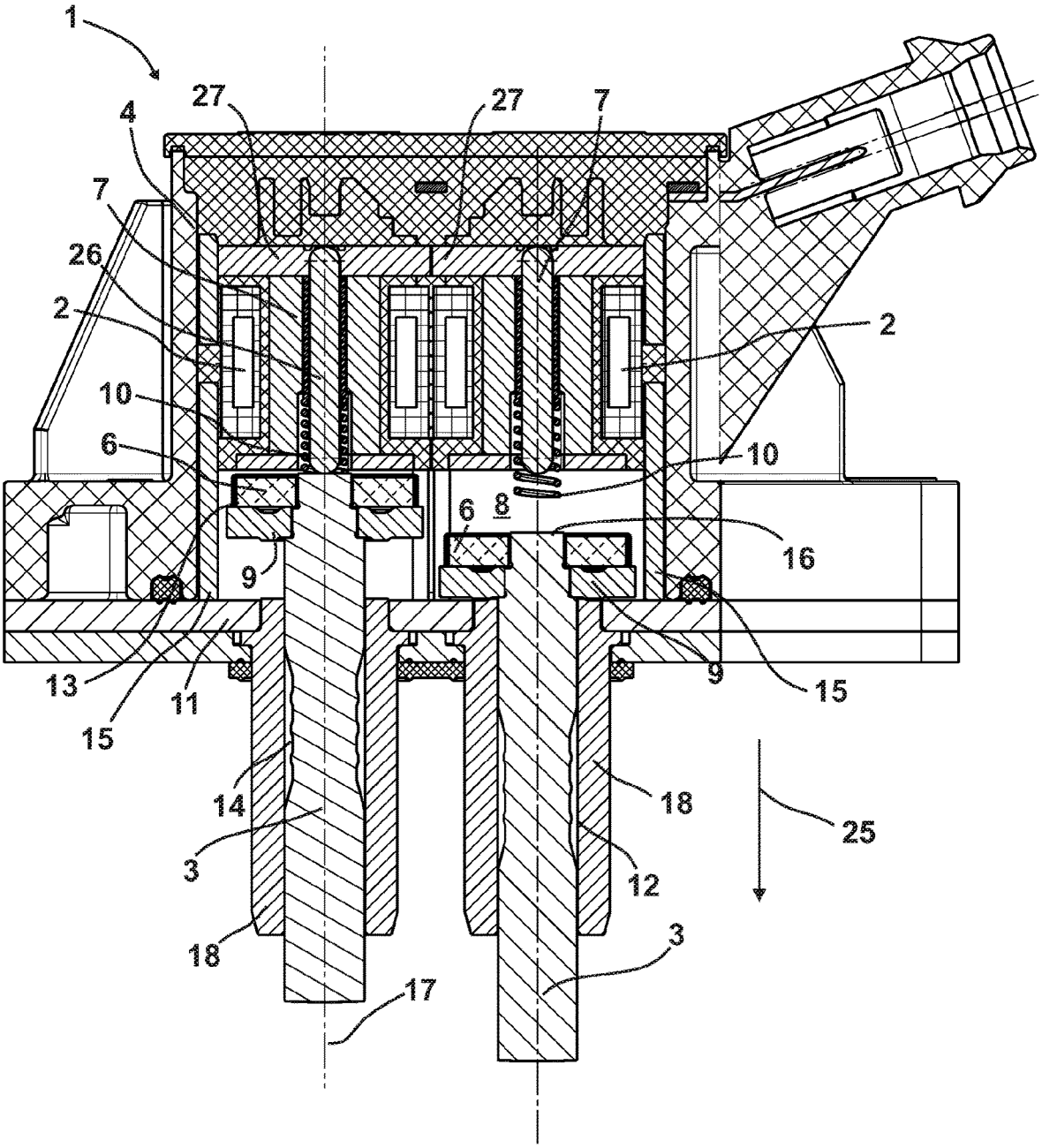

FIG. 4 shows a further actuator 1 according to the invention, which is constructed largely similar to that shown in FIG. 3. In a departure from the actuator 1 shown in FIG. 3, plunger guides 12 are arranged here in separate guide bodies 18 which are connected to housing 4 through plate 11. Guide bodies 18 are connected to plate 11 with little mobility or play, so that the actuator 1 can be connected in a simple manner to a connection component of an engine, typically a cylinder head cover, even if there are manufacturing tolerances in the engine as well as in the case of actuator 1 are used in the most unfavorable manner or a mechanical interface on the motor has position and/or position deviations. Guide bodies 18 and thus an alignment of the longitudinal axes 17 of plungers 3 can thus be achieved by the movable connection of guide bodies 18 to housing 4 or on plate 11 can be easily adapted to the relevant conditions. It goes without saying that guide bodies 18 can then also be moved relative to one another and that the longitudinal axes 17 of plungers 3 may no longer be exactly parallel.

With an actuator 1 according to the invention, a bistable actuator 1 for camshaft adjustment is achieved in a particularly simple manner, which ensures a particularly simple and therefore inexpensive guidance of plungers 3.

The invention claimed is:

1. An electromagnetic actuator comprising:

at least two electromagnetic actuator units, each electromagnetic actuator unit including:

a coil;

a core concentrically arranged within and rigidly connected to the coil;

a plunger coaxially aligned with the coil and the core, the plunger configured to translate axially in relation to the coil and the core based on an energization of the coil;

a stop rigidly connected to the core such that the plunger rests against an at least partially spherical surface of the stop when the plunger is in a first end position proximate to the core; and a plunger guide coaxially aligned with the coil and the core, the plunger guide configured to slidably receive the plunger, wherein each plunger guide is further configured to move in relation to one another.

2. The electromagnetic actuator according to claim 1, wherein:

the at least two electromagnetic actuator units are arranged in a common housing.

3. The electromagnetic actuator according to claim 1, wherein:

in each electromagnetic actuator unit, the plunger is further configured to switch between the first end position proximate to the core, and a second end position away from the core; and each plunger rests against a stop arranged at each end position.

4. The electromagnetic actuator according to claim 3, wherein:

in each electromagnetic actuator unit, the stop is arranged in a pass-through hole formed in the core.

5. The electromagnetic actuator according to claim 1, wherein:

each electromagnetic actuator unit further includes a permanent magnet arranged on the plunger.

6. The electromagnetic actuator according to claim 5, wherein:

in each electromagnetic actuator unit, the permanent magnet is magnetically separated from the core in an axial direction only through an air gap.

7. The electromagnetic actuator according to claim 1, wherein:

each electromagnetic actuator unit further includes an anchor plate arranged on the plunger.

8. The electromagnetic actuator according to claim 1, wherein:

each electromagnetic actuator unit further includes a permanent magnet and an armature element arranged on the plunger, the armature element protruding radially beyond the permanent magnet.

9. The electromagnetic actuator according to claim 8, wherein:

each electromagnetic actuator unit further includes a spring configured to connect the plunger to the coil.

10. The electromagnetic actuator according to claim 9, wherein:

in each electromagnetic actuator unit, the spring, the armature element, the permanent magnet, and the coil cooperate so as to move the plunger a predefined minimum distance to the first end position as the plunger approaches the first end position when the coil is de-energized.

11. The electromagnetic actuator according to claim 9, wherein:

in each electromagnetic actuator unit, the spring, the armature element, the permanent magnet, and the coil cooperate so as to move the plunger from the first end position to a second end position away from the core.

12. The electromagnetic actuator according to claim 9, wherein:

in each electromagnetic actuator unit, the spring, the armature element, the permanent magnet, and the coil cooperate so as to maintain the plunger in a second end position away from the core independently of the energization of the coil such that the plunger is enabled to move out of the second end position only when an additional force is applied to the plunger.

13. The electromagnetic actuator according to claim 1, wherein:

each electromagnetic actuator unit further includes a spring configured to connect the stop to the coil.

14. The electromagnetic actuator according to claim 1, wherein:

in each electromagnetic actuator unit, the stop rests against a yoke disk fixed to the core.

15. The electromagnetic actuator according to claim 14, wherein:

in each electromagnetic actuator unit, the stop is arranged in a pass-through hole formed in the core so as to extend beyond first and second axial ends of the core.

16. The electromagnetic actuator according to claim 1, wherein:

each plunger guide is arranged in a separate guide body which are configured to move in relation to each other.

17. The electromagnetic actuator according to claim 16, wherein:

in each electromagnetic actuator unit, the plunger includes a central taper that remains within the plunger guide as the plunger translates.

18. The electromagnetic actuator according to claim 1, wherein:

in each electromagnetic actuator unit, a maximum external diameter of the core is less than or equal to an inner diameter of the coil.

19. The electromagnetic actuator according to claim 18, wherein:

each electromagnetic actuator unit further includes a component made of a magnetically conductive material arranged on at least one axial end of the core, the component protruding radially beyond the core.

20. The electromagnetic actuator according to claim 19, wherein:

each component is a plate-shaped component.

21. The electromagnetic actuator according to claim 1, wherein:

each stop is a ball or a pin.

22. A camshaft actuator for adjusting an axially movable sleeve on a camshaft of an internal combustion engine, the camshaft actuator comprising the electromagnetic actuator according to claim 1.

23. The electromagnetic actuator according to claim 1, wherein:

each stop comprises:

a ball; or a pin including a hemispherical end surface.

* * * * *